US011502455B2

(12) United States Patent
Hong et al.

(10) Patent No.: US 11,502,455 B2
(45) Date of Patent: Nov. 15, 2022

(54) CONNECTOR WITH LIMITING PORTIONS TO ALLOW AN INSERTION SECTION AND A MATING SECTION TO BE ACCOMMODATED IN AN INTERNAL SPACE MORE STABLY

(71) Applicant: Dongguan Luxshare Technologies Co., Ltd, Dongguan (CN)

(72) Inventors: Bing-Nan Hong, Dongguan (CN); Yung-Chih Hung, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/214,459

(22) Filed: Mar. 26, 2021

(65) Prior Publication Data

US 2021/0218185 A1 Jul. 15, 2021

(30) Foreign Application Priority Data

Nov. 20, 2020 (TW) ..... 109140873

(51) Int. Cl.

| | |
|---|---|
| ***H01R 13/629*** | (2006.01) |
| ***H01R 13/40*** | (2006.01) |
| ***H01R 43/16*** | (2006.01) |
| ***H01R 13/11*** | (2006.01) |
| ***H01R 13/502*** | (2006.01) |

(52) U.S. Cl.

CPC ..... *H01R 13/629* (2013.01); *H01R 13/11* (2013.01); *H01R 13/40* (2013.01); *H01R 13/502* (2013.01); *H01R 43/16* (2013.01)

(58) Field of Classification Search

CPC ..... H01R 13/629; H01R 13/11; H01R 13/40; H01R 13/502; H01R 43/16

USPC ..... 439/296

See application file for complete search history.

(56) References Cited

U.S. PATENT DOCUMENTS 6,186,830 B1 * 2/2001 Lin ..... H01R 13/6594 439/79

6,299,492 B1 10/2001 Pierini et al.

(Continued)

FOREIGN PATENT DOCUMENTS

CN 2548282 Y 4/2003

CN 201207494 Y 3/2009

(Continued)

*Primary Examiner* — Peter G Leigh

(74) *Attorney, Agent, or Firm* — Birch, Stewart, Kolasch & Birch, LLP

(57) ABSTRACT

A connector includes a sheet terminal and an insulating base. The sheet terminal includes a bend section, a mating section, and an insertion section. The insertion section includes a shoulder extending outward along an insertion axis, and the top of the shoulder corresponds to the mating section. The insulating base includes a base and a mating portion. The base includes two opposite base sidewalls, an accommodation space, and a stop portion. The insertion section is located in the accommodation space. The stop portion corresponds to the shoulder. The mating portion is connected to the base. The mating portion includes two opposite mating sidewalls and a mating space. The mating space is in communication with the accommodation space, and the mating section is located in the mating space.

16 Claims, 8 Drawing Sheets

(56) References Cited

U.S. PATENT DOCUMENTS

| | | | | |
|---|---|---|---|---|
| 8,043,097 | B2 * | 10/2011 | Ngo | H01R 12/7088 439/744 |
| 8,591,250 | B2 * | 11/2013 | Chin | H01R 12/724 439/947 |
| 2004/0192119 | A1 | 9/2004 | Sakurai et al. | |
| 2006/0166536 | A1 * | 7/2006 | Northey | H01R 12/778 439/188 |
| 2008/0214027 | A1 | 9/2008 | Schell et al. | |
| 2010/0184339 | A1 * | 7/2010 | Ngo | H01R 12/7088 439/682 |
| 2020/0303859 | A1 * | 9/2020 | Liang | H01R 12/724 |

FOREIGN PATENT DOCUMENTS

| | | | | |
|---|---|---|---|---|
| CN | 202111336 | U | | 1/2012 |
| CN | 103050812 | A | | 4/2013 |
| CN | 203119143 | U | * | 8/2013 |
| CN | 103943994 | A | | 7/2014 |
| CN | 105742877 | A | | 7/2016 |
| CN | 105789950 | A | | 7/2016 |
| CN | 111525324 | A | | 8/2020 |
| TW | 202029587 | A | | 8/2020 |
| TW | M600019 | U | | 8/2020 |
| TW | M602747 | U | | 10/2020 |

* cited by examiner

CONNECTOR WITH LIMITING PORTIONS TO ALLOW AN INSERTION SECTION AND A MATING SECTION TO BE ACCOMMODATED IN AN INTERNAL SPACE MORE STABLY

CROSS-REFERENCE TO RELATED APPLICATION

This non-provisional application claims priority under 35 U.S.C. § 119(a) to Patent Application No. 109140873 filed in Taiwan, R.O.C. on Nov. 20, 2020, the entire contents of which are hereby incorporated by reference.

BACKGROUND

Technical Field

The present invention provides a connector, and in particular, to a connector of an elbow female socket.

Related Art

Nowadays, connectors are commonly used in various electronic devices. However, in structures of the connectors, due to structural design problems, particularly, for a connector of an elbow female socket, when the connector is connected to an external device, exceptions, such as terminal retraction, terminal deflection, and/or true position deviation of a weld leg, are often caused.

SUMMARY

In view of this, according to some embodiments, a connector includes a sheet terminal and an insulating base. The sheet terminal includes a bend section, a mating section, and an insertion section. The mating section has a mating axis, and the bend section is connected to the mating section and the insertion section. The insertion section includes a shoulder extending outward along an insertion axis, and the top of the shoulder corresponds to the mating section. The insulating base includes a base and a mating portion. The base includes two opposite base sidewalls, an accommodation space between the two base sidewalls, and a stop portion, where the insertion section is located in the accommodation space, and the stop portion corresponds to the shoulder. The mating portion is connected to the base. The mating portion includes two opposite mating sidewalls and a mating space between the mating sidewalls, the mating space is in communication with the accommodation space, and the mating section is located in the mating space.

According to some embodiments, the base includes a top wall, and the stop portion includes the top wall.

According to some embodiments, the connector includes a plurality of sheet terminals, the base includes a plurality of stop portions, and the stop portions respectively correspond to the shoulders of the sheet terminals.

According to some embodiments, each insertion section includes a limiting portion, one of the base sidewalls includes a plurality of limiting slots, and the limiting portions are respectively located in the limiting slots.

According to some embodiments, one of the base sidewalls includes a plurality of guide slots, the guide slots are respectively connected to the limiting slots, and a depth of each guide slot is deeper than that of the corresponding limiting slot.

According to some embodiments, the other end of each insertion section relative to the corresponding bend section includes an insertion end, and distances from all the limiting portions to the corresponding insertion ends are different.

According to some embodiments, the base further includes a vertical wall, and a distance between the limiting portion farther from the vertical wall and the corresponding insertion end is longer than a distance between the limiting portion closer to the vertical wall and the corresponding insertion end.

According to some embodiments, the base further includes a vertical wall, and a distance between the limiting portion farther from the vertical wall and the corresponding insertion end is shorter than a distance between the limiting portion closer to the vertical wall and the corresponding insertion end.

According to some embodiments, a terminal base is further included, the terminal base includes a plurality of slots, each insertion end includes fish-eye feet, and the fish-eye feet are respectively located in the slots.

According to some embodiments, each mating section includes a positioning portion, one of the mating sidewalls includes a plurality of positioning slots, and the positioning portions are respectively located at the positioning slots.

According to some embodiments, one of the mating sidewalls includes a block, and the block is separately located in an opening of the mating space, and corresponds to the other end of the mating section relative to the bend section.

According to some embodiments, each insertion section includes two limiting portions, each base sidewall includes a plurality of limiting slots, and the limiting portions are respectively located at the limiting slots; each base sidewall includes a plurality of guide slots, the guide slots are respectively connected to the limiting slots, and a depth of each guide slot is smaller than that of the corresponding limiting slot; the other end of each insertion section relative to the corresponding bend section includes an insertion end, a base includes a vertical wall, and a distance between the limiting portion farther from the vertical wall and the corresponding insertion end is smaller than a distance between the limiting portion closer to the vertical wall and the corresponding insertion end; a connector further includes a terminal base, the terminal base includes a plurality of slots, each insertion end includes fish-eye feet, and the fish-eye feet are respectively located in the slots; each mating section includes two positioning portions, each mating sidewall includes a plurality of positioning slots, and the positioning portions are respectively located in the positioning slots; and each mating sidewall includes a block, the block is separately located in an opening of the mating space, and corresponds to the other end of each mating section relative to the bend section.

Detailed features and advantages of the present invention are described in detail in the following implementations, and the content of the implementations is sufficient for a person skilled in the art to understand and implement the technical content of the present invention. A person skilled in the art can easily understand the objectives and advantages related to the present invention according to the contents disclosed in this specification, the claims, and the drawings.

DETAILED DESCRIPTION

Figure 1A:
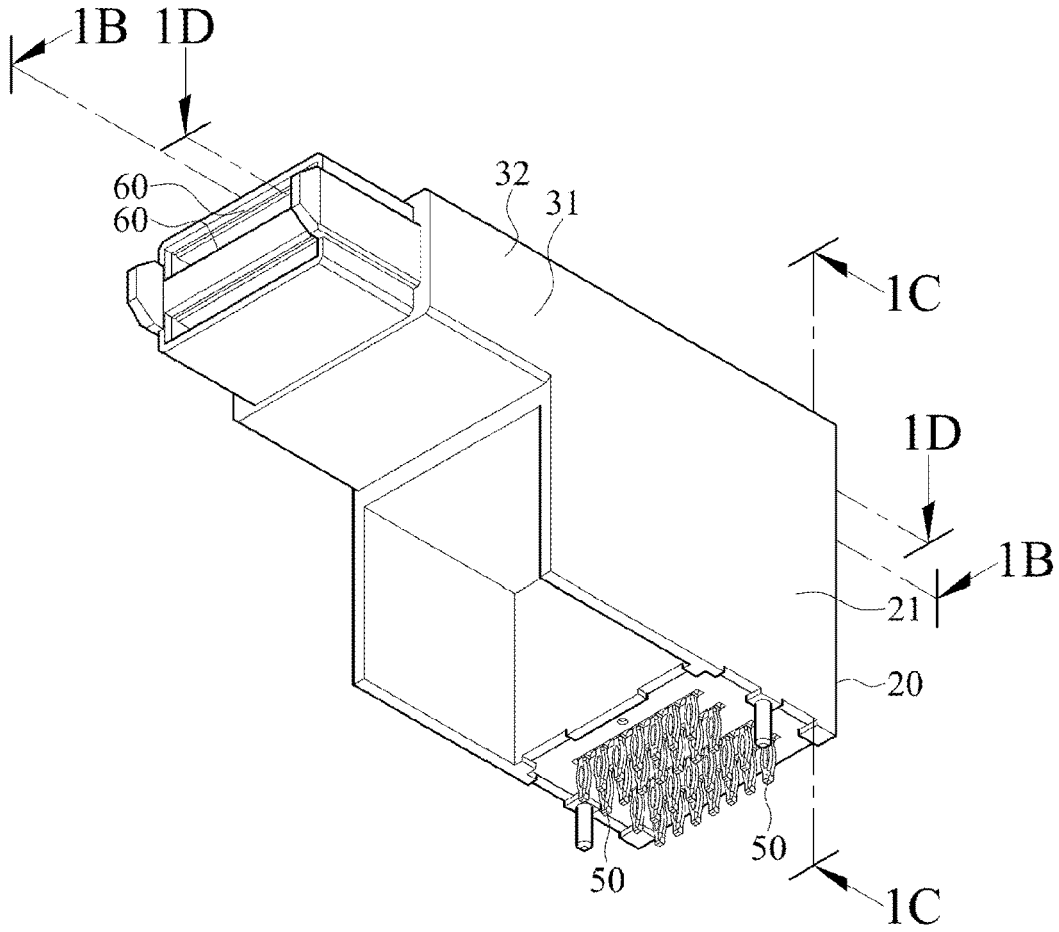
FIG. 1A is a schematic diagram of a connector according to some embodiments.
Figure 1B:
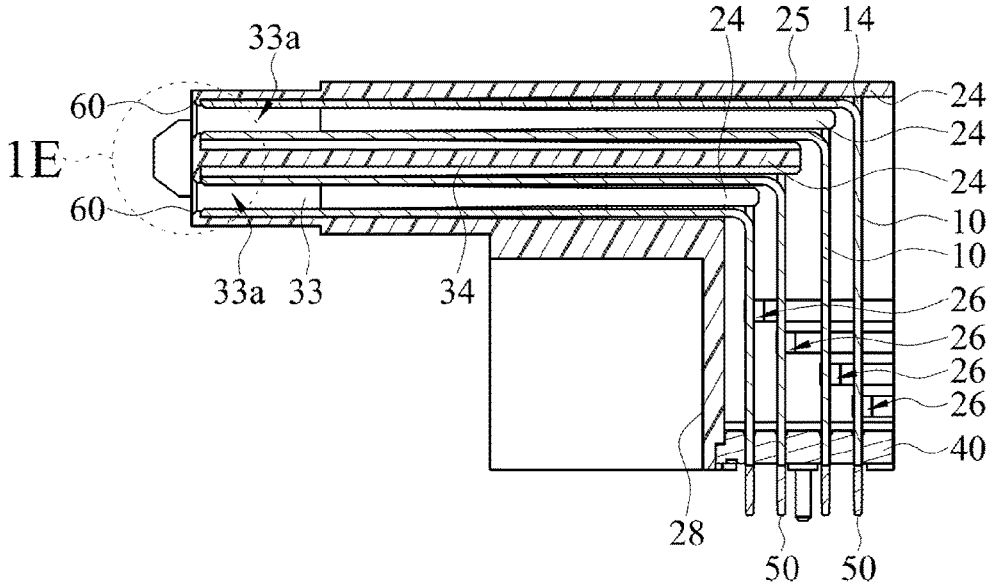
FIG. 1B is a cross-sectional view of the connector in FIG. 1A at a position 1B-1B.
Figure 1C:
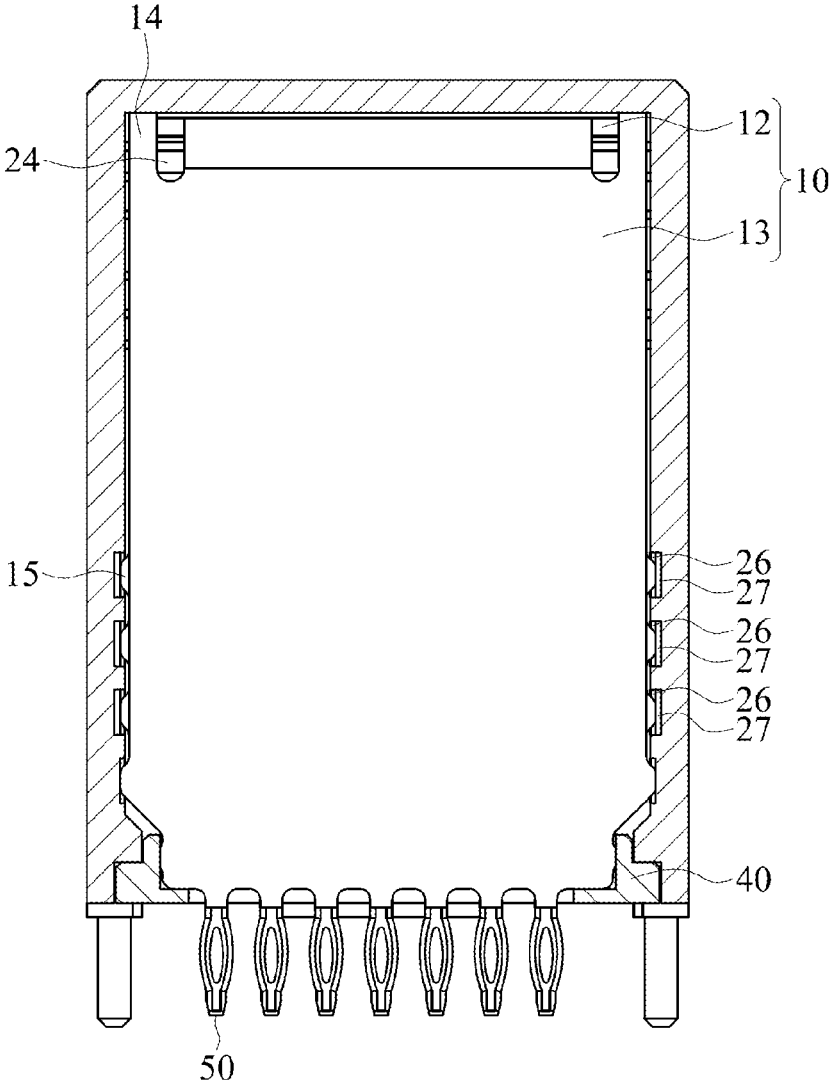
FIG. 1C is a cross-sectional view of the connector in FIG. 1A at a position 1C-1C.
Figure 1D:
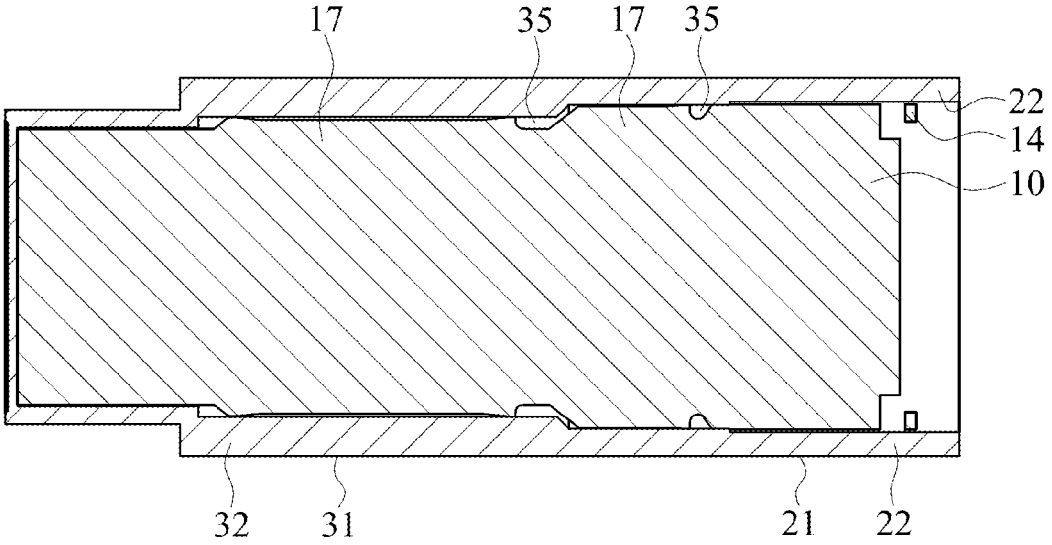
FIG. 1D is a cross-sectional view of the connector in FIG. 1A at a position 1D-1D.
Figure 1E:
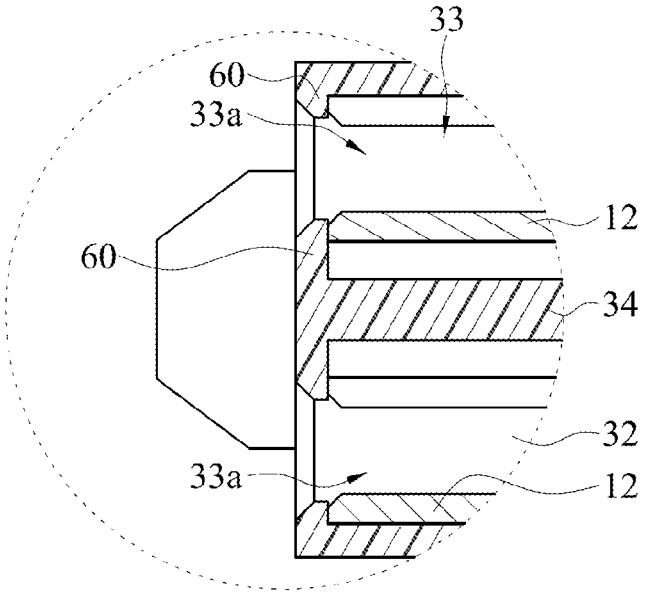
FIG. 1E is a partial enlarged view of a circle in FIG. 1B.
Figure 2A:
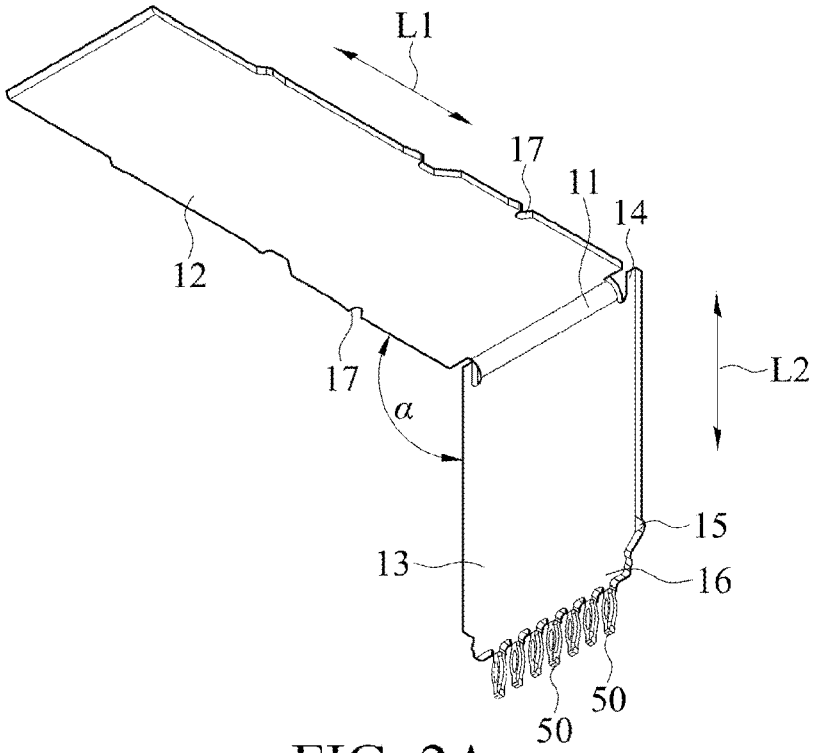
FIG. 2A is a schematic diagram of a sheet terminal according to some embodiments.
Figure 2B:
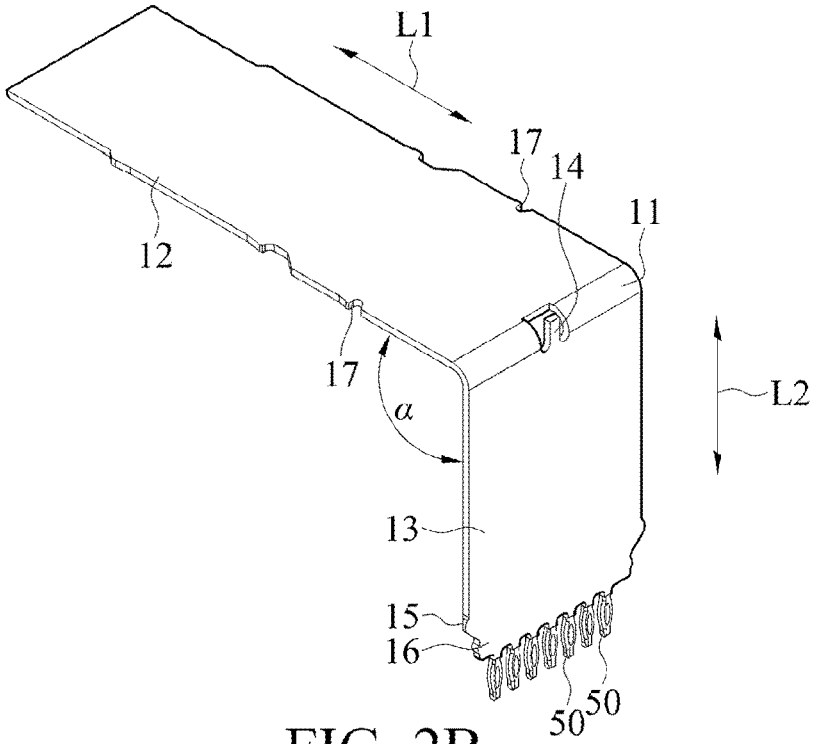
FIG. 2B is a schematic diagram of another embodiment of a shoulder of a sheet terminal according to some embodiments.
Figure 3A:
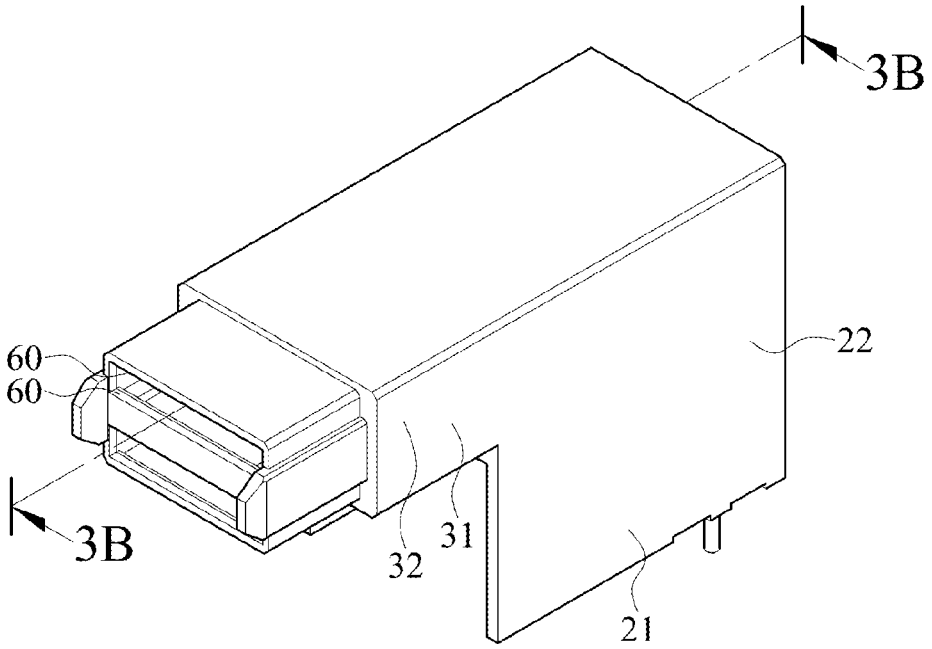
FIG. 3A is a schematic diagram of an insulating base according to some embodiments.
Figure 3B:
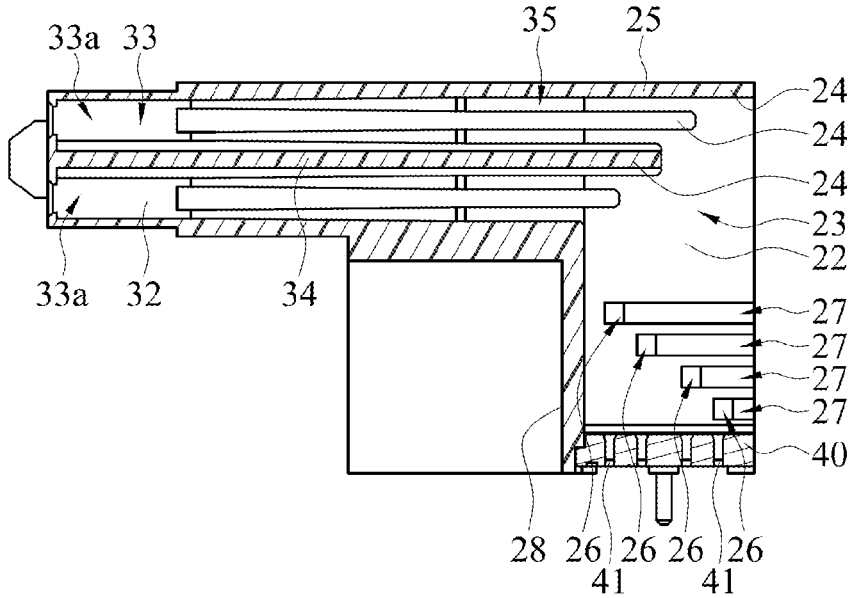
FIG. 3B is a cross-sectional view of the insulating base in FIG. 3A at a position 3B-3B.
Figure 3C:
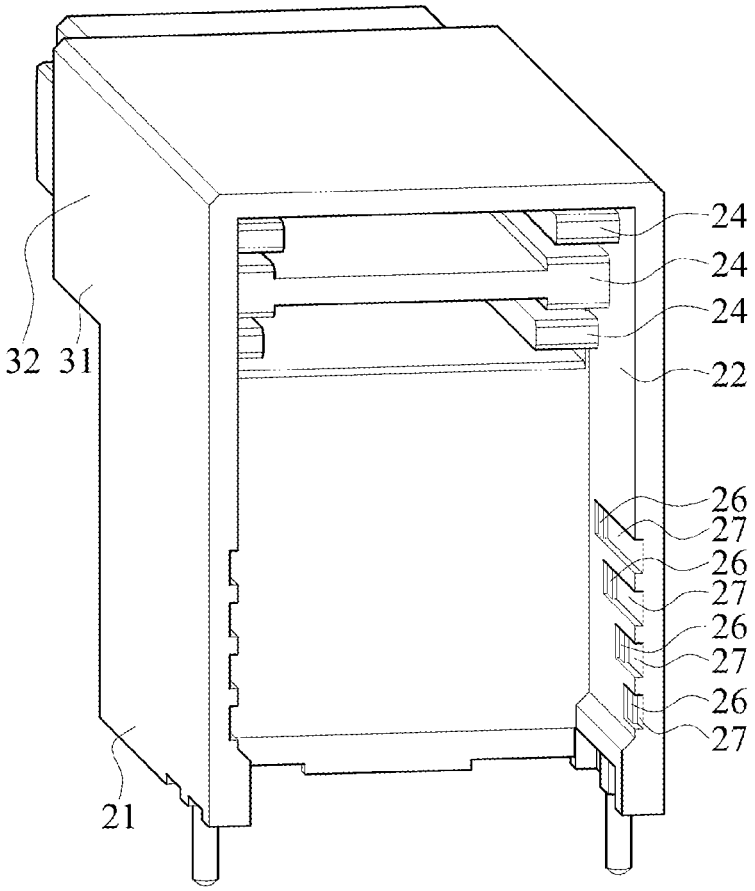
FIG. 3C is a schematic diagram of an insulating base from another perspective according to some embodiments.
Figure 3D:
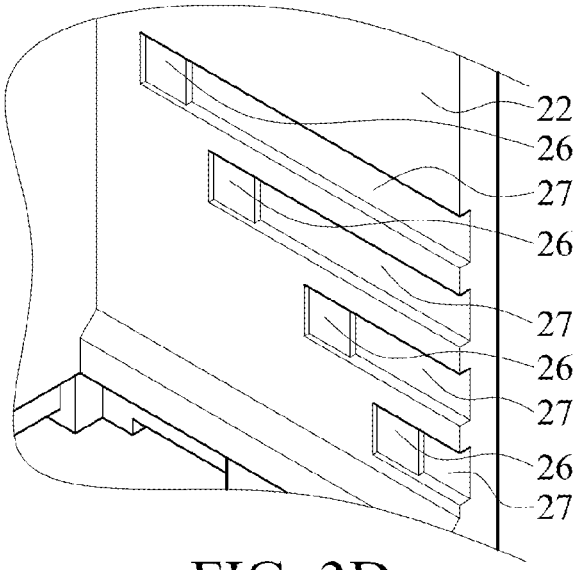
FIG. 3D is a schematic diagram of a limiting slot and a guide slot according to some embodiments.

Referring to FIG. 1A to FIG. 3D, FIG. 1A is a schematic diagram of a connector according to some embodiments. FIG. 1B is a cross-sectional view of the connector in FIG. 1A at a position 1B-1B. FIG. 1C is a cross-sectional view of the connector in FIG. 1A at a position 1C-1C. FIG. 1D is a cross-sectional view of the connector in FIG. 1A at a position 1D-1D. FIG. 1E is a partial enlarged view of a circle in FIG. 1B. FIG. 2A is a schematic diagram of a sheet terminal according to some embodiments. Perspectives of the schematic diagrams in FIG. 2A and FIG. 2B are opposite, FIG. 2A and FIG. 1A have the same perspective (viewed from below the connector), and FIG. 2B is viewed from above the connector. FIG. 3A is a schematic diagram of an insulating base according to some embodiments. FIG. 3B is a cross-sectional view of the insulating base in FIG. 3A at a position 3B-3B. FIG. 3C is a schematic diagram of an insulating base from another perspective according to some embodiments. FIG. 3D is a schematic diagram of a limiting slot and a guide slot according to some embodiments.

Referring to FIG. 1A, FIG. 1B, and FIG. 2A, the connector includes a sheet terminal 10 and an insulating base 20. The sheet terminal 10 includes a bend section 11, a mating section 12, and an insertion section 13. The bend section 11 is connected to the mating section 12 and the insertion section 13 and is between the mating section 12 and the insertion section 13. In some embodiments, the mating section 12 has a mating axis L1, and the insertion section 13 has an insertion axis L2 and a shoulder 14. The insertion axis L2 intersects with the mating axis L1, so that an angle $\alpha$ exists between the mating section 12 and the insertion section 13. In some embodiments, the angle $\alpha$ between the mating section 12 and the insertion section 13 is preferably 90 degrees. In some embodiments, the shoulder 14 extends upward (the upward direction in FIG. 2A) along the insertion axis L2. Based on this, the top of the shoulder 14 corresponds to the mating section 12. The top of the shoulder 14 may be the top end or a top plane. In some embodiments, the top of the shoulder 14 is substantially flush with the top of the mating section 12 and is not higher than the top of the mating section 12, that is, the top of the shoulder 14 and the top of the mating section 12 are substantially located in the same plane. In some embodiments, the top of the shoulder 14 protrudes from the top of the mating section 12 and is higher than the mating section 12 by a predetermined distance. The predetermined distance enables the top of the shoulder 14 to approach or come into contact with a stop portion 24 (described below in detail). In some embodiments, after the insertion section 13 needs to subject to an external force, the top of the shoulder 14 is actuated to approach or come into contact with the stop portion 24 of the base 21. When coming into contact with the stop portion 24 of the base, the top of the shoulder 14 has an abutting function, to prevent the insertion section 13 from being deformed due to the force.

Referring to FIG. 2B, FIG. 2B is a schematic diagram of another embodiment of a shoulder of a sheet terminal. In some embodiments, as shown in FIG. 2A, a single insertion section 13 includes two shoulders 14, the shoulders 14 are respectively located at two sides of the insertion section 13 and extend upward along the insertion axis L2. Based on this, positions of the two shoulders 14 are respectively located at two ends of the bend section 11. In some embodiments, as shown in FIG. 2B, a single insertion section 13 includes a shoulder 14, the shoulder 14 is located at the insertion section 13 and extends upward along the insertion axis L2. Based on this, a position of the shoulder 14 is located between the two ends of the bend section 11. In other embodiments, a quantity of the shoulders 14 may be set to be more than one, and a specific quantity may be set according to requirements, which is not limited specifically herein.

Referring to FIG. 1A, FIG. 1B, FIG. 3A, FIG. 3B and FIG. 3C, FIG. 3C is a schematic diagram of an insulating base from another perspective according to some embodiments. The insulating base 20 includes a base 21 and a mating portion 31. In some embodiments, the base 21 includes two opposite base sidewalls 22, an accommodation space 23 between the two base sidewalls 22, and a stop portion 24, where the insertion section 13 is located in the accommodation space 23, and the stop portion 24 corresponds to the shoulder 14. Further, when the sheet terminal 10 is located in the insulating base 20, the insertion section 13 is located in the accommodation space 23, and the stop portion 24 corresponds to the shoulder 14, so that the shoulder 14 can abut against or come into contact with the stop portion 24. When the shoulder 14 abuts against or comes into contact with the stop portion 24, the insertion section 13 is stopped by the stop portion 24, thereby preventing the insertion section 13 from being deformed due to a force.

The mating portion 31 is connected to the base 21. In some embodiments, the mating portion 31 includes two opposite mating sidewalls 32 and a mating space 33 between the two mating sidewalls 32, the mating space 33 is in communication with the accommodation space 23, and the mating section 12 is located in the mating space 33. Further, when the sheet terminal 10 is located in the insulating base 20, the mating section 12 is located in the mating space 33, and is located in a space different from that of the insertion section 13. In some embodiments, when the sheet terminal 10 is located in the insulating base 20, the mating section 12 is partially located in the mating space 33, and is partially located in the accommodation space 23.

Referring to FIG. 3B, in some embodiments, the base 21 includes a top wall 25, and the stop portion 24 includes the top wall 25. Further, when the sheet terminal 10 is located in the insulating base 20, the stop portion 24 located at the top wall 25 corresponds to the shoulder 14, so that the shoulder 14 can abut against or come into contact with the stop portion 24.

Referring to FIG. 1A, FIG. 1B and FIG. 3B, in some embodiments, the connector includes a plurality of sheet terminals 10, the mating portion 31 includes a plurality of separating plates 34. The separating plates 34 divide the mating space 33 into a plurality of mating channels 33*a*, and the mating sections 12 of the plurality of sheet terminals 10 are respectively located at the mating channels 33*a*. In this embodiment, preferably, there is one separating plate 34 and four sheet terminals 10. The separating plate 34 divides the mating space 33 into two mating channels 33*a*, and the mating sections 12 of the four sheet terminals 10 are respectively located in pairs in the mating channels 33*a*. Through disposition of the separating plate 34, the sheet terminals 10 are respectively located in the mating channel 33*a* without interfering with each other. In some embodiments, the base 21 includes a plurality of stop portions 24, the stop portions 24 are respectively disposed on the two base sidewalls 22, the shoulders 14 correspondingly abut against the stop portions 24, the stop portions 24 each include a top wall 25, and the separating plates 34 may be disposed on the stop portions 24. Further, each stop portion 24 separately corresponds to the shoulder 14 of each sheet terminal 10. Therefore, when the top of the shoulder 14 comes into contact with the stop portion 24, the stop portion 24 has an abutting function, to prevent the insertion section 13 from being deformed due to a force.

Referring to FIG. 1B, FIG. 1C, FIG. 2A, FIG. 3B and FIG. 3D, FIG. 1C is a cross-sectional view of the connector in FIG. 1A at a position 1C-1C. FIG. 3D is a schematic diagram of a limiting slot and a guide slot according to some embodiments; In some embodiments, the insertion section 13 of each sheet terminal 10 includes a limiting portion 15 (FIG. 2A), one of the base sidewalls 22 include a plurality of limiting slots 26, and the limiting portions 15 are respectively located in the limiting slots 26. In some embodiments, preferably, there are two limiting portions 15 of the insertion section 13, and the two limiting portions 15 are respectively located at corresponding positions on two sides of the insertion sections 13. Based on this, the two base sidewalls 22 both include the limiting slots 26 at the corresponding positions. Therefore, when the insertion section 13 is located in the accommodation space 23, each limiting portion 15 abuts against the limiting slot 26. In some embodiments, the base sidewalls 22 each include a plurality of guide slots 27, the guide slots 27 are respectively connected to the limiting slots 26, and a depth of each guide slot 27 is deeper than that of the corresponding limiting slot 26. Further, when the insertion section 13 is to be placed into the accommodation space 23, through disposition of the guide slot 27, a travel path for placing the insertion section 13 may be more stable, and when the limiting portion 15 is about to reach the limiting slot 26, because the depth of the limiting slot 26 is relatively small, that is, the depth of the limiting slot 26 is smaller than that of the guide slot 27, when the limiting portion 15 is pushed to the limiting slot 26, the limiting portion 15 abuts against the limiting slot 26, so that the insertion section 13 can be more stable in the accommodation space 23.

Figure 4A:
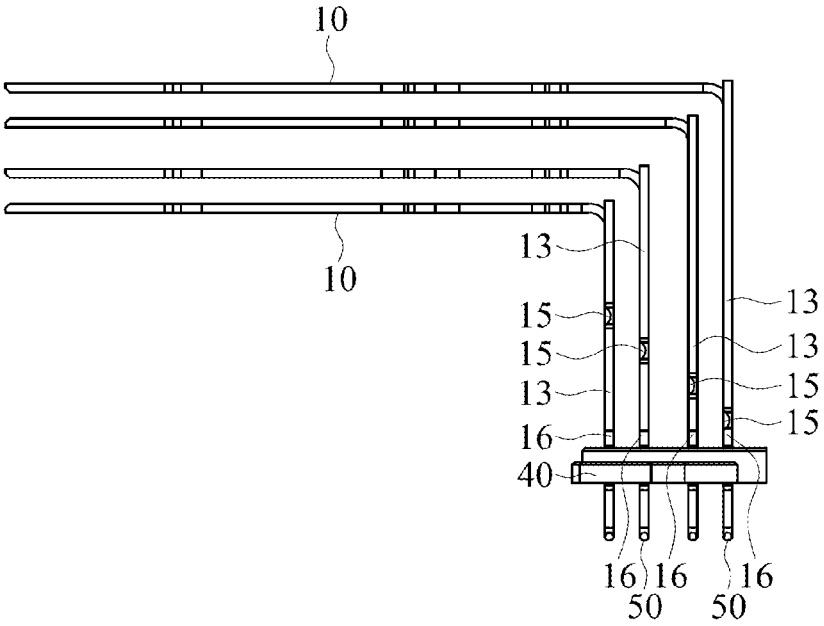
FIG. 4A is a schematic diagram of a limiting portion of a sheet terminal according to some embodiments.

Referring to FIG. 2A and FIG. 4A, in some embodiments, the other end of each insertion section 13 relative to the corresponding bend section 11 includes an insertion end 16, and distances from the limiting portions 15 on different insertion sections 13 to the corresponding insertion ends 16 are different Further, the insertion section 13 of each sheet terminal 10 includes the limiting portion 15, and distances from the limiting portions 15 on the different sheet terminals 10 to the corresponding insertion ends 16 are different. Therefore, the limiting portions 15 on the different sheet terminals 10 are not in the same horizontal position.

Referring to FIG. 1B and FIG. 4A, FIG. 4A is a schematic diagram of a limiting portion of a sheet terminal according to some embodiments. In some embodiments, the base 21 further includes a vertical wall 28, a distance between the limiting portion 15 farther from the vertical wall 28 and the corresponding insertion end 16 is shorter than a distance between the limiting portion 15 closer to the vertical wall 28 and the corresponding insertion end 16. Based on this, the limiting portions 15 on the different sheet terminals 10 are not in the same horizontal position. In addition, as shown in FIG. 4A, the limiting portions 15 are presented in an arrangement from upper left to lower right.

Figure 4B:
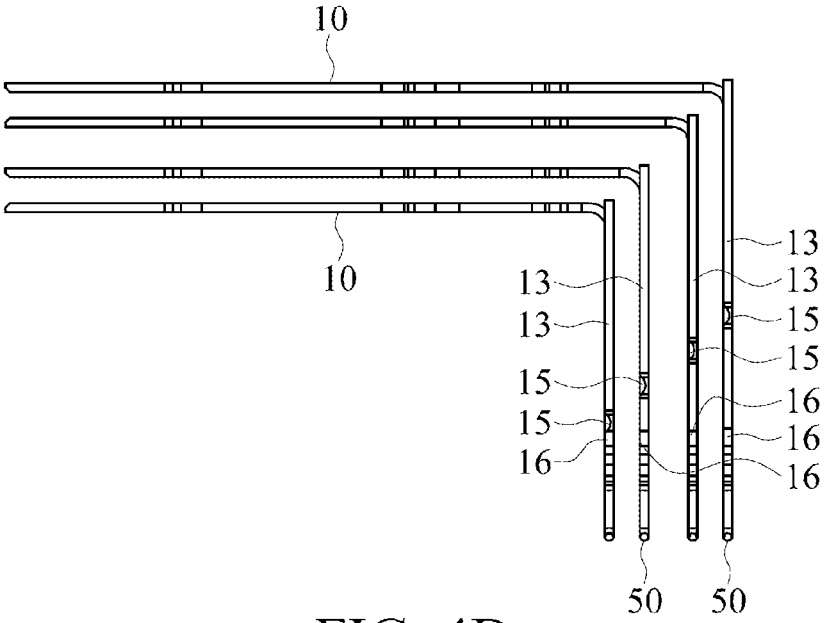
FIG. 4B is a schematic diagram of another embodiment of a limiting portion of a sheet terminal according to some embodiments.
Figure 5:
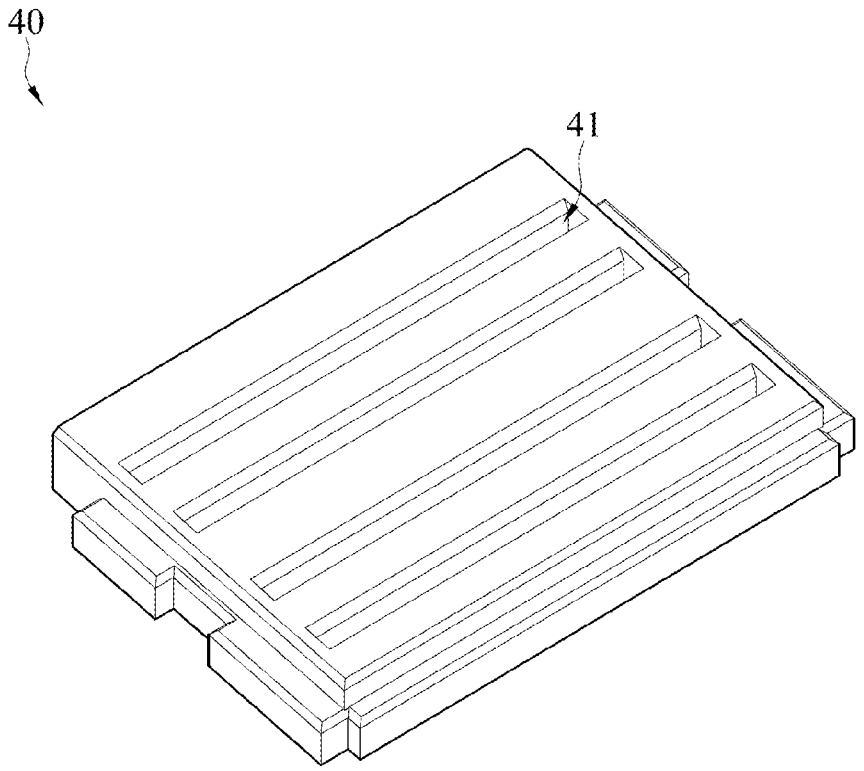
FIG. 5 is a schematic diagram of a terminal base according to some embodiments.

Referring to FIG. 4B, FIG. 4B is a schematic diagram of another embodiment of a limiting portion of a sheet terminal according to some embodiments. In some embodiments, the base 21 further includes a vertical wall 28 (as shown in FIG. 1B), a distance between the limiting portion 15 farther from the vertical wall 28 and the corresponding insertion end 16 is longer than a distance between the limiting portion 15 closer to the vertical wall 28 and the corresponding insertion end 16. Therefore, the limiting portions 15 on the different sheet terminals 10 are not in the same horizontal position. In addition, as shown in FIG. 4B, the limiting portions 15 are presented in an arrangement from upper right to lower left. Based on this, in this embodiment, positions of a plurality of limiting slots 26 of the base sidewall 22 are set corresponding to the positions of the limiting portion 15 in this embodiment.

Referring to FIG. 1B, FIG. 2A, FIG. 3B, and FIG. 5, FIG. 5 is a schematic diagram of a terminal base according to some embodiments. In some embodiments, the connector further includes a terminal base 40, and the terminal base 40 is connected to the base 21 and fixed to an opening on a lower side of the accommodation space 23. The terminal base 40 includes a plurality of slots 41, each insertion end 16 includes one or more fish-eye feet 50, the fish-eye feet 50 are respectively located in the corresponding slots 41. Through disposition of the plurality of slots 41, the fish-eye feet 50 on each insertion end 16 do not interfere with each other. In some embodiments, preferably, there are a plurality of fish-eye feet 50, each insertion end 16 includes a plurality of fish-eye feet 50, and each insertion end 16 corresponds to a slot 41. In some embodiments, the slot 41 may be elongated. Therefore, the plurality of fish-eye feet 50 on the same insertion end 16 are located in the same slot 41.

Referring to FIG. 1D, FIG. 2A and FIG. 3B, FIG. 1D is a cross-sectional view of the connector in FIG. 1B at a position 1D-1D. In some embodiments, each mating section 12 includes a positioning portion 17. Based on this, one of the mating sidewalls 32 includes a plurality of positioning slots 35, and the positioning portions 17 are respectively located in the positioning slots 35. In some embodiments, the connector includes a plurality of sheet terminals 10, the mating section 12 on each sheet terminal 10 includes a positioning portion 17. Therefore, the positioning portion 17 on the sheet terminal 10 may abut against the corresponding positioning slot 35. In some embodiments, preferably, there are two positioning portions 17 of the mating section 12 on each sheet terminal 10, and the two positioning portions 17 are respectively located at corresponding positions on two sides of the mating section 12 in a pair. Based on this, the two mating sidewalls 32 both include the positioning slots 35 at the corresponding positions. Therefore, when the mating section 12 is located in the mating space 33, each positioning portion 17 abuts against the positioning slot 35. In some embodiments, the mating section 12 on each sheet terminal 10 includes a plurality of pairs of positioning portions 17. Based on this, the positioning slots 35 are disposed corresponding to positions of the plurality of pairs of positioning portions 17. In some embodiments, the plurality of positioning portions 17 on the same side of the mating section 12 are disposed approximately in a stepped shape. Further, the second positioning portion 17 on the same side slightly protrudes from the first positioning portion 17. Based on this, the positioning slot 35 is also approximately in a stepped shape in correspondence with the positioning portion 17 that is in a stepped shape. The step-shaped structures of the positioning slot 35 and the positioning portion 17 that correspond to each other abut against each other, so that the mating section 12 is more stable when located in the mating space 33.

Referring to FIG. 1A, FIG. 1B, and FIG. 1E, FIG. 1E is a partial enlarged view of a circle in FIG. 1B. In some embodiments, one of the mating sidewalls 32 includes a block 60, and the block 60 is separately located in an opening of the mating space 33, and corresponds to the other end of the mating section 12 relative to the bend section 11. Further, when the mating section 12 is located in the mating space 33, the other end of the mating section 12 relative to the bend section 11 abuts against the block 60 without protruding from the opening of the mating space 33. Furthermore, the block 60 is disposed at the opening of the mating space 33, the mating section 12 can be prevented from penetrating backward too deeply.

Referring to FIG. 1A to FIG. 4A, in some embodiments, each insertion section 13 includes two limiting portions 15, and each base sidewall 22 includes a plurality of limiting slots 26. Based on this, the limiting portions 15 are respectively located in the corresponding limiting slots 26. In addition, each base sidewall 22 includes a plurality of guide slots 27, the guide slots 27 are respectively connected to the corresponding limiting slots 26, and a depth of each guide slot 27 is deeper than that of the corresponding limiting slot 26. Moreover, the other end of each insertion section 13 relative to the corresponding bend section 11 includes an insertion end 16, and the base 21 includes a vertical wall 28. A distance between the limiting portion 15 farther from the vertical wall 28 and the corresponding insertion end 16 is shorter than a distance between the limiting portion 15 closer to the vertical wall 28 and the corresponding insertion end 16. In addition, the connector further includes the terminal base 40, the terminal base 40 includes a plurality of slots 41, each insertion end 16 includes a plurality of fish-eye feet 50, and the fish-eye feet 50 are respectively located in the corresponding slots 41 herein. Each mating section 12 includes two positioning portions 17, each mating sidewalls 32 includes a plurality of positioning slots 35, and the positioning portions 17 are respectively located in the corresponding positioning slots 35. Each mating sidewall 32 includes a block 60, each block 60 is separately located in an opening of the mating space 33, and corresponds to the other end of the mating section 12 relative to the bend section 11.

In conclusion, in some embodiments, when a connector comes into contact with a stop portion through the top of a shoulder, the stop portion has an abutting function. In addition, an insertion section and a limiting slot abut against each other through a limiting portion, so that the insertion section can be accommodated in an accommodation space more stably, and a mating section and a positioning slot abut against through a positioning portion, so that the mating section is more stable when located in a mating space, thereby resolving the problems that at least one of exceptions, such as terminal retraction, terminal deflection, and/or true position deviation of a weld leg, that is often caused when a conventional connector is connected to an external device.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector, comprising:

a sheet terminal, comprising:

a bend section;

a mating section having a mating axis; and an insertion section, wherein the bend section is connected to the mating section and the insertion section, and the insertion section comprises a shoulder extending outward along an insertion axis; and an insulating base, comprising:

a base, comprising two opposite base sidewalls, an accommodation space between the two base sidewalls, and a stop portion, wherein the insertion section is located in the accommodation space, and the stop portion corresponds to the shoulder; and a mating portion, connected to the base, wherein the mating portion comprises two opposite mating sidewalls and a mating space between the mating sidewalls, the mating space is in communication with the accommodation space, and the mating section is located in the mating space;

wherein each insertion section comprises a limiting portion, one of the base sidewalls comprises a plurality of limiting slots, and the limiting portions are respectively located in the limiting slots; the base sidewalls each comprise a plurality of guide slots, the guide slots are respectively connected to the limiting slots, and a depth of each guide slot is deeper than that of the corresponding limiting slot.

2. The connector according to claim 1, wherein the base comprises a top wall, and the stop portion comprises the top wall.

3. The connector according to claim 1, wherein the connector comprises a plurality of sheet terminals, the base comprises a plurality of stop portions, and the stop portions respectively correspond to the shoulders of the sheet terminals.

4. The connector according to claim 3, wherein each mating section comprises a positioning portion, one of the mating sidewalls comprises a plurality of positioning slots, and the positioning portions are respectively located in the positioning slots.

5. The connector according to claim 3, wherein one of the mating sidewalls comprises a block, and the block is separately located in an opening of the mating space, and corresponds to the end of each mating section relative to the bend section.

6. The connector according to claim 1, wherein each mating section comprises a positioning portion, one of the mating sidewalls comprises a plurality of positioning slots, and the positioning portions are respectively located in the positioning slots.

7. The connector according to claim 1, wherein one of the mating sidewalls comprises a block, and the block is separately located in an opening of the mating space, and corresponds to the end of each mating section relative to the bend section.

8. The connector according to claim 1, wherein the end of each insertion section relative to the corresponding bend section comprises an insertion end, and distances from all the limiting portions to the corresponding insertion ends are different.

9. The connector according to claim 8, wherein each mating section comprises a positioning portion, one of the mating sidewalls comprises a plurality of positioning slots, and the positioning portions are respectively located in the positioning slots.

10. The connector according to claim 8, wherein one of the mating sidewalls comprises a block, and the block is separately located in an opening of the mating space, and corresponds to the end of each mating section relative to the bend section.

11. The connector according to claim 8, wherein the base further comprises a vertical wall, and a distance between the limiting portion farther from the vertical wall and the corresponding insertion end is longer than a distance between the limiting portion closer to the vertical wall and the corresponding insertion end.

12. The connector according to claim 11, wherein each mating section comprises a positioning portion, one of the mating sidewalls comprises a plurality of positioning slots, and the positioning portions are respectively located in the positioning slots.

13. The connector according to claim 11, wherein one of the mating sidewalls comprises a block, and the block is separately located in an opening of the mating space, and corresponds to the end of each mating section relative to the bend section.

14. The connector according to claim 8, wherein the base further comprises a vertical wall, and a distance between the limiting portion farther from the vertical wall and the corresponding insertion end is shorter than a distance between the limiting portion closer to the vertical wall and the corresponding insertion end.

15. The connector according to claim 14, wherein each mating section comprises a positioning portion, one of the mating sidewalls comprises a plurality of positioning slots, and the positioning portions are respectively located in the positioning slots.

16. The connector according to claim 14, wherein one of the mating sidewalls comprises a block, and the block is separately located in an opening of the mating space, and corresponds to the end of each mating section relative to the bend section.

* * * * *